US005422450A

United States Patent [19]

Miyazawa et al.

[11] Patent Number: 5,422,450

[45] Date of Patent: Jun. 6, 1995

[54] VACUUM CIRCUIT BREAKER ACTUATING ASSEMBLY

[75] Inventors: Takayuki Miyazawa; Junji Fujiwara, both of Tokyo; Kimiya Satoh, Saitama; Makoto Taniguchi; Satoshi Ogawa, both of Tokyo, all of Japan

[73] Assignee: Kabushiki Kaisha Toshiba, Kawasaki, Japan

[21] Appl. No.: 130,451

[22] Filed: Oct. 1, 1993

[30] Foreign Application Priority Data

Jan. 20, 1993 [JP] Japan ..... 5-007101

[51] Int. Cl.[6] ..... H01H 33/42; H01H 33/66

[52] U.S. Cl. ..... 218/140

[58] Field of Search ..... 200/144 R, 144 B, 145, 200/146 R, 148 R–148 H

[56] References Cited

U.S. PATENT DOCUMENTS

| | | | |
|---|---|---|---|
| 3,784,774 | 1/1974 | Wilson | 200/144 B |
| 4,550,234 | 10/1985 | Steinemer | 200/144 B |
| 4,593,165 | 6/1986 | Steinemer | 200/144 B |
| 4,996,397 | 2/1991 | Kuhn et al. | 200/144 B |
| 5,155,315 | 10/1991 | Malkin et al. | 200/148 R |

FOREIGN PATENT DOCUMENTS

| | | | |
|---|---|---|---|
| 60-230328 | 11/1985 | Japan | H01H 33/66 |
| 1094032 | 12/1967 | United Kingdom | H01H 33/66 |
| 1222869 | 2/1971 | United Kingdom | H01H 33/38 |
| 2095475 | 9/1982 | United Kingdom | H01H 3/20 |
| 2099630 | 12/1982 | United Kingdom | H01H 33/66 |

OTHER PUBLICATIONS

High-Voltage Switchgear Catalogue HG5 Catalog of Circuit-Breakers AEG-Telefunken pp. 2, 11, 26.

*Primary Examiner*—J. R. Scott

*Attorney, Agent, or Firm*—Oblon, Spivak, McClelland, Maier, & Neustadt

[57] ABSTRACT

A vacuum circuit breaker including a vacuum interrupter with a fixed electrode and a movable electrode arranged to be moved into contact with or separated from the fixed electrode. The vacuum circuit breaker includes a movable rod mounted on the movable electrode, an operating mechanism unit for generating operating force to perform the opening and closing operation of the vacuum interrupter, a main shaft mounted on the operating mechanism unit and a drive lever rotatably mounted on the operating mechanism unit by the main shaft for transmitting the operating force towards the vacuum interrupter. The vacuum circuit breaker further includes a crank lever rotatably mounted at a working end of the drive lever and a pressurizing unit provided in the drive lever and the crank lever for generating resilient force to resiliently maintain closed condition of the vacuum interrupter. A first end of the crank lever is linked to the movable rod and transmits the operating force to the movable rod and a second end of the crank lever is linked to the pressurizing unit and transmits the resilient force to the movable rod.

7 Claims, 5 Drawing Sheets

VACUUM CIRCUIT BREAKER ACTUATING ASSEMBLY

BACKGROUND OF THE INVENTION

1. Field of the Invention

This invention relates to a vacuum circuit breaker, and more particularly to a vacuum circuit breaker chiefly used for the protection of power receiving and distributing equipment.

2. Description of the Related Art

FIG. 3 shows an example of a prior art vacuum circuit breaker. In this Figure, 41 is an interrupting unit, and 50 is an operating mechanism unit. Interrupting unit 41 includes a plurality (only one shown in the drawing) of vacuum interrupters 43 arranged in a box-shaped insulating casing 42. Vacuum interrupter 43 incorporates a fixed electrode and a movable electrode that can be moved up against or separated from the fixed electrode. A fixed rod mounted on this fixed electrode is fixed to a top end plate 44. A movable rod 46 mounted on the movable electrode is mounted movably in the axial direction on a bottom end plate 45 by means of a bellows. Respective main circuit isolator units 47*a*, 47*b* of the fixed electrode and movable electrode are connected from these electrodes to the outside of the insulating casing 42. 48 is an insulating rod linked to movable rod 46. A linkage mechanism, not shown, of operating mechanism unit 50 is assembled within frame 51 that is unitary with a truck. Only parts subsequent to (or downstream of) an output level 52 which constitute parts of the linkage mechanism, are shown in the Figure. An output lever 52 is rotatably mounted on frame 51 by means of a main shaft 53. Its other end is linked to one end of a connecting rod 54 which is assembled with a contacts pressurizing spring 55. The other end of connecting rod 54 is linked to the drive end of a drive lever 57 which is rotatably mounted by means of a support shaft 56. The working end of drive lever 57 is linked to the bottom end of insulating rod 48. The rated voltage of the vacuum circuit breaker can be altered by changing the separation between the fixed and movable electrodes within vacuum interrupter 43 i.e. by changing the contact gap. Adjustment of this contact gap is effected by altering the length of drive lever 57.

Thus, when a circuit-making instruction is applied from outside, the linkage mechanism in operating mechanism unit 50 is actuated to turn output lever 52 in the clockwise direction, driving connecting rod 54 downwards so that contacts pressurizing spring 55 is compressed and drive lever 57 is rotated in the counter-clockwise direction. As a result, movable rod 46 is driven upwards by means of insulating rod 48 so that the movable electrode contacts the fixed electrode, thereby closing the electrodes of vacuum interrupter 43. This electrodes-closed condition is maintained by the resilient force provided by contacts pressurizing spring 55.

In the contrary process, when an open-circuit instruction is supplied from outside, releasing a trip catch, not shown, incorporated in operating mechanism unit 50, output lever 52 is rotated counter-clockwise by the restoring force of contacts pressurizing spring 55 etc., thereby causing drive lever 57 to be rotated in the clockwise direction. As a result, movable rod 46 is moved downwardly and the electrodes of vacuum interrupter 43 are opened.

A further prior art example is shown in FIG. 4. In this prior art example, operating mechanism unit 50A is incorporated at the bottom of interrupting unit 41 and a contacts pressurizing spring 58 is provided on part of a connecting rod that connects the other end of output lever 52 and the bottom end of insulating rod 48.

In the prior art example of FIG. 3, since contacts pressurizing spring 55 is provided in the vertical direction between the other end of output lever 52 and the drive end of drive lever 57, in operating mechanism unit 50, the height of operating mechanism unit 50 is raised by the length of contacts pressurizing spring 55. This is one factor that increases the dimensions of operating mechanism unit 50. A further problem was that, if the size of the contacts gap was increased in order to raise the rated voltage, since this increases the length of drive lever 57, the size of the vacuum circuit breaker is increased.

Furthermore, since contacts pressurizing spring 55 is separated from support shaft 56 by a certain distance, the moment of contacts pressurizing spring 55 is added to the rotational moment of drive lever 57. This is a factor that delays the speed of opening and closing of the contacts.

In the prior art example of FIG. 4, since contacts pressurizing spring 58 is provided vertically between the other end of output lever 52 and the bottom end of insulating rod 48 in operating mechanism unit 50A, the height of breaker unit 41 is raised by the length of contacts pressurizing spring 58. This is one factor that increases the dimensions of the vacuum circuit breaker as a whole.

SUMMARY OF THE INVENTION

Accordingly, one object of this invention is to provide a vacuum circuit breaker capable of being made small in size.

Another object of this invention is to provide a vacuum circuit breaker which can increase the speed of opening and closing of the contacts.

These and other objects of this invention can be achieved by providing a vacuum circuit breaker including a vacuum interrupter with a fixed electrode and a movable electrode arranged to be moved into contact with or separated from the fixed electrode. The vacuum circuit breaker includes a movable rod mounted on the movable electrode, an operating mechanism unit for generating an operating force to perform the opening and closing operation of the vacuum interrupter, a main shaft mounted on the operating mechanism unit and a drive lever rotatably mounted on the operating mechanism unit by the main shaft for transmitting the operating force towards the vacuum interrupter. The vacuum circuit breaker further includes a crank lever rotatably mounted at a working end of the drive lever and a pressurizing unit provided in the drive lever and the crank lever for generating a resilient force to resiliently maintain a closed condition of the vacuum interrupter. A first end of the crank lever is linked to the movable rod and transmits the operating force to the movable rod and a second end of the crank lever is linked to the pressurizing unit and transmits the resilient force to the movable rod.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
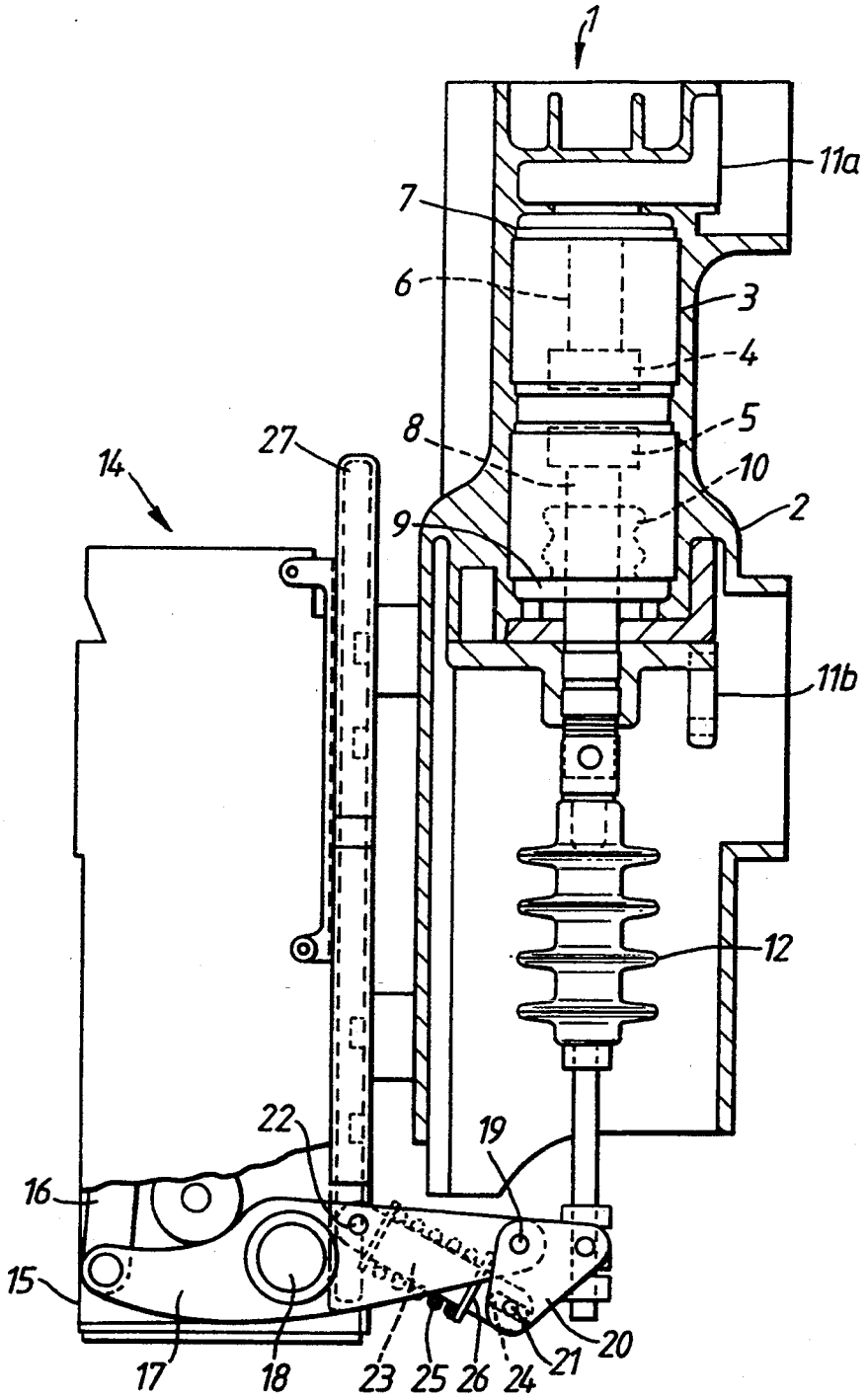
FIG. 1 is a constructional diagram showing a first embodiment of a vacuum circuit breaker according to this invention.

Referring now to the drawings, wherein like reference numerals designate identical or corresponding parts throughout the several views, the embodiments of this invention will be described below.

Figure 3:
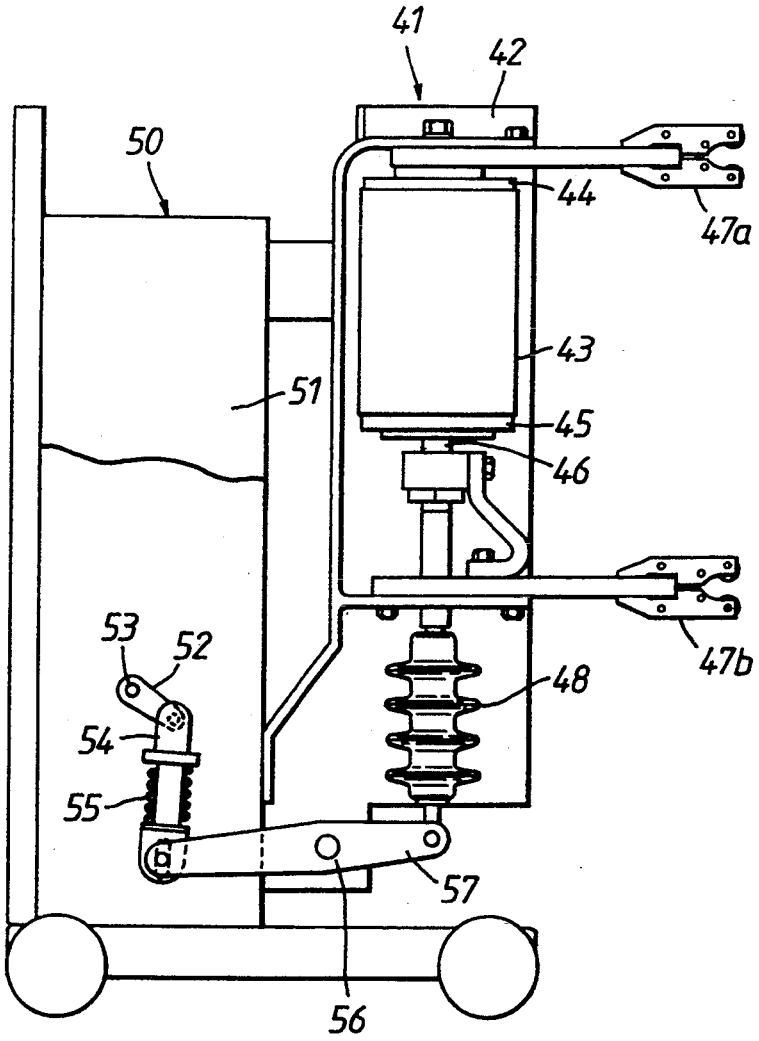
Fig.3 (PRIOR ART)
FIG. 3 is a constructional diagram of a prior art vacuum circuit breaker.
Figure 4:
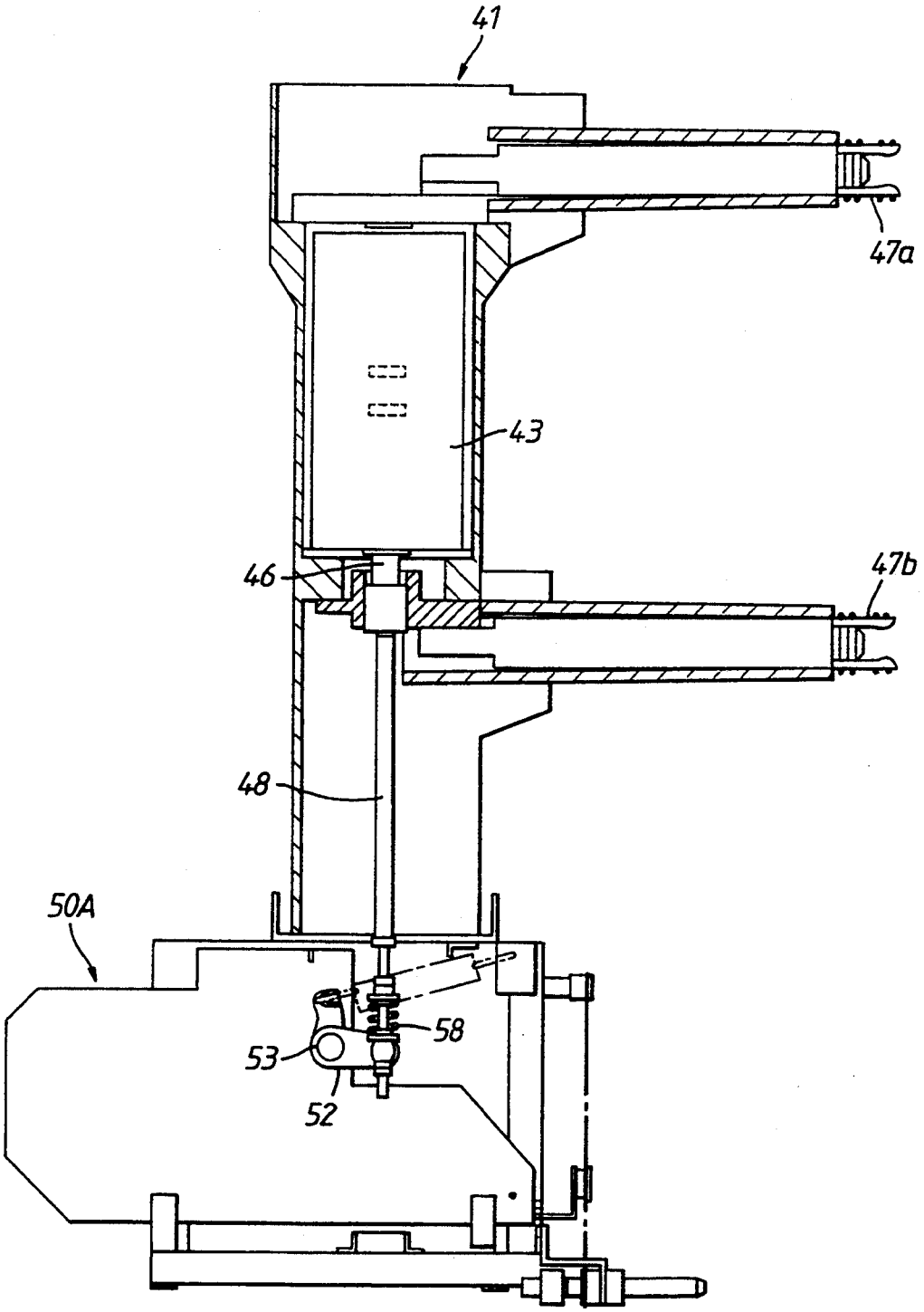
Fig.4 (PRIOR ART)
FIG. 4 is a constructional diagram showing a further prior art example.
Figure 5:
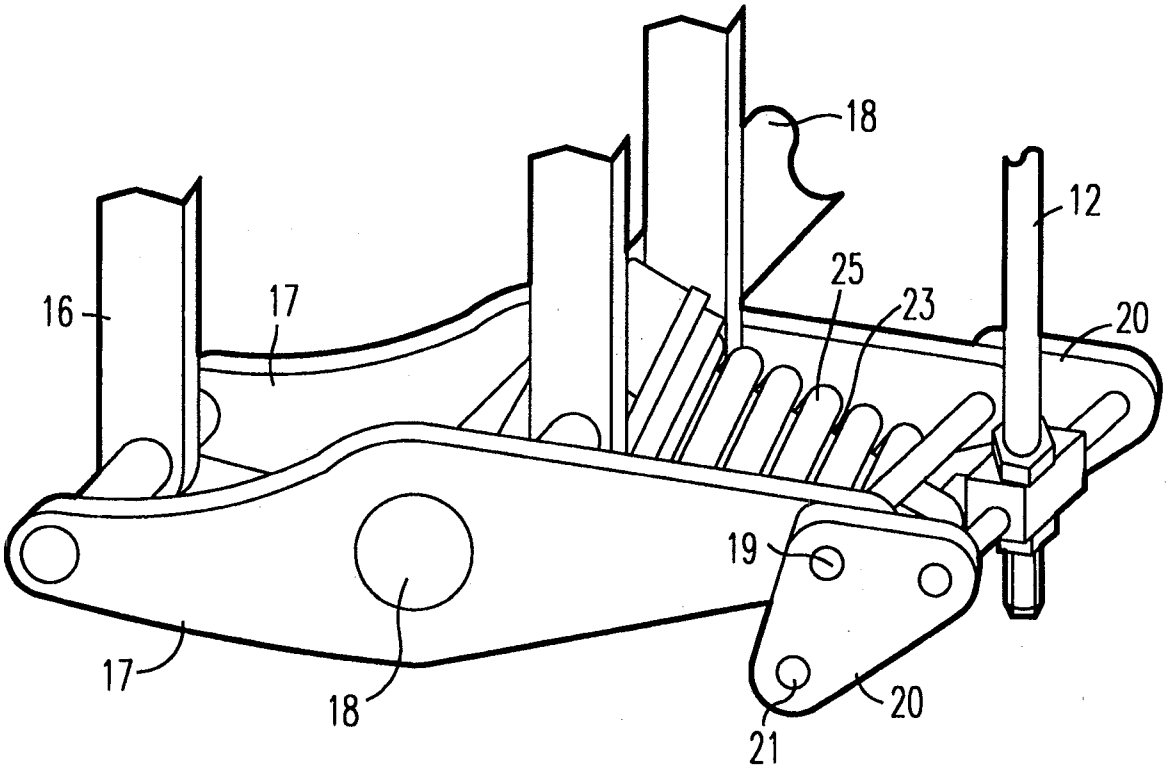
FIG. 5 is a perspective view of the drive lever-crank lever arrangement of FIG. 1.

FIG. 1 is a view showing a first embodiment of this invention. In this Figure, 1 is an interrupting unit and 14 is an operating mechanism unit. A vacuum interrupter 3 (only one shown in the drawing) is arranged within an insulating casing 2 in interrupting unit 1. Vacuum interrupter 3 incorporates a fixed electrode 4 and a movable electrode 5 that can be moved up to or separated from this fixed electrode 4. A fixed rod 6 mounted on fixed electrode 4 is fixed to top end plate 7. A movable rod 8 mounted on movable electrode 5 is mounted movably in the axial direction on a bottom end plate 9 by means of a bellows 10. Conductors 11*a* and 11*b* constituting respective main circuit isolators are led out from fixed electrode 4 and movable electrode 5. 12 is an insulating rod that is linked to movable rod 8. The construction within a frame 15 of operating mechanism unit 14 is not shown, because it is almost the same as that of operating mechanism unit 50 shown in FIG. 3. Different parts are described below. A link 16 transmits the operating force generated in operating mechanism unit 14. A drive lever 17 transmits the operating force of operating mechanism unit 14 towards interrupting unit 1 is rotatably mounted at the bottom of frame 15 on a main shaft 18, which is the output shaft. Link 16 is linked to drive lever 17 at its drive end. Drive lever 17 is formed by two plates with a suitable spacing therebetween (FIG. 5). A crank lever 20 constituting a small lever is also formed by two plates with a suitable spacing therebetween and is rotatably mounted at the working end of drive lever 17 by means of a support shaft 19. One end of crank lever 20 is linked to the bottom end of insulating rod 12. A support shaft 22 is provided in drive lever 17 at the vicinity of main shaft 18. A spring shaft 23 extends between a support shaft 21 provided at the other end of crank lever 20 and support shaft 22 and is arranged such that it is positioned between the two plates of drive lever 17. A contacts pressurizing spring 25 is fitted on this spring shaft 23. This mode of assembly ensures that the dead space between two plates in drive lever is effectively used. Support shaft 21 is movable within a slot 24 formed in spring shaft 23 so that when crank lever 20 is rotated in the clockwise direction contacts pressurizing spring 25 is compressed by a member 26 that moves together with support shaft 21. The contacts pressurizing force that resiliently maintains the contacting condition of fixed electrode 4 and movable electrode 5 is obtained by the compression of contacts pressurizing spring 25. A mounting frame 27 is used for mounting the vacuum circuit breaker on a truck or the like.

Next, the operation of the vacuum circuit breaker constructed as above will be described. When a circuit-making instruction is supplied from outside, first operating mechanism unit 14 is actuated, rotating drive lever 17 in the counter-clockwise direction through link 16. Upon rotation of this drive lever 17, crank lever 20 and contacts pressurizing spring 25 also rotate in the same direction as drive lever 17 about main shaft 18 as their center of rotation. As a result, movable shaft 8 is driven upwardly by means of insulating rod 12 until movable electrode 5 is brought into contact with fixed electrode 4. From the time-point at which these two electrodes 4 and 5 come into contact, as drive lever 17 is further rotated in the counter-clockwise direction, crank lever 20 is rotated clockwise about support shaft 19, with the result that support shaft 21 is moved along slot 24, compressing contacts pressurizing spring 25. The reaction of this contacts pressurizing spring 25 acts through insulating rod 12 in the direction tending to lift the movable rod 8, so that the closed-electrodes condition of vacuum interrupter 3 is resiliently maintained. In the opposite process to this, when a circuit-opening instruction is applied from outside, drive lever 17 is rotated in the clockwise direction by means of link 16, with the result that crank lever 20 is rotated in the counter-clockwise direction, restoring the original condition of contacts pressurizing spring 25 and moving movable rod 8 downwards to open the electrodes of vacuum interrupter 3.

With this embodiment, since contacts pressurizing spring 25 is arranged in the dead space between two plates in drive lever 17, which is between main shaft 18 and insulating rod 12, size reduction of operating mechanism unit 14 and interrupting unit 1 can be achieved. Furthermore, putting contacts pressurizing spring 25 close to main shaft 18 reduces the inertial moment, enabling the speed of opening and closing vacuum interrupter 3 to be raised.

A second embodiment of this invention will now be described with reference to FIG. 2. The construction in which a crank lever 30 is rotatably mounted by means of a support shaft 29 at the working end of a drive lever 28 with one end thereof linked to the bottom end of insulating rod 12 is practically the same as that of the first embodiment. In this embodiment, a support 31 is provided at a location in the vicinity above main shaft 18 on mounting frame 27. A spring shaft 34 extends between a support shaft 32 provided on this support 31 and a support shaft 33 provided at the other end of crank lever 30, such that it is positioned between two plates in drive lever 28. Contacts pressurizing spring 36 is fitted on this spring shaft 34. Support shaft 33 is movable in a slot 35 formed in spring shaft 34 so that when crank lever 30 is rotated clockwise, contacts pressurizing spring 36 is compressed by a member 37 that moves together with support shaft 33.

Next, the operation of the vacuum circuit breaker constructed as above will be described. When a circuit-making instruction is supplied from outside, first operating mechanism unit 14 is actuated, rotating drive lever 28 in the counter-clockwise direction through link 16. Upon rotation of this drive lever 28, crank lever 30 and contacts pressurizing spring 36 also rotate in the same direction as drive lever 28 about main shaft 18 as their center of rotation. As a result, movable rod 8 is driven upwardly by means of insulating rod 12 until movable electrode 5 is brought into contact with fixed electrode 4. From the time-point at which these two electrodes 4 and 5 come into contact, as drive lever 28 is further rotated in the direction, crank lever 30 is rotated clockwise about support shaft 29, with the result that support shaft 33 is moved along slot 35, compressing contacts pressurizing spring 36. The reaction of this contact pressurizing spring 36 acts through insulating rod 12 in the direction tending to lift the movable rod 8, so that the closed-electrodes condition of vacuum interrupter 3 is resiliently maintained.

In the opposite process to this, when a circuit-opening instruction is applied from outside, drive lever 28 is rotated in the clockwise direction by means of link 16, with the result that crank lever 30 is rotated in the counter-clockwise direction, restoring the original condition of contacts pressurizing spring 36 and moving movable rod 8 downwards to open the electrodes of vacuum interrupter 3.

As described above, with this embodiment, since one support shaft 32 of spring shaft 34 is provided on a support 31 in the upper vicinity of main shaft 18, support shaft 33 rotates about support shaft 32 as its center of rotation and support shaft 29 rotates about main shaft 18 as its center of rotation. As a result, the movement of crank lever 30 is altered by the position of main shaft 18 and support shaft 32. Consequently, the amount of the gap (i.e., between contacts) of vacuum interrupter 3 can be altered since it is possible to adjust the angle of rotation of crank lever 30 with respect to drive lever 28, by altering the height position of support shaft 32 of spring shaft 34 i.e. the position of arrangement of support 31. It is therefore not necessary to increase the length etc. of the drive lever 28 in order to increase the contacts gap so as to raise the rated voltage. This makes it possible to reduce the size of the vacuum circuit breaker. Also, by increasing the angle in the axial direction of spring shaft 34 with respect to drive lever 28, contacts pressurizing force created by contacts pressurizing spring 36 is applied downwards, so the initial opening speed of vacuum interrupter 3 can be raised. This makes it possible to improve the breaking characteristics of the vacuum circuit breaker.

Figure 2:
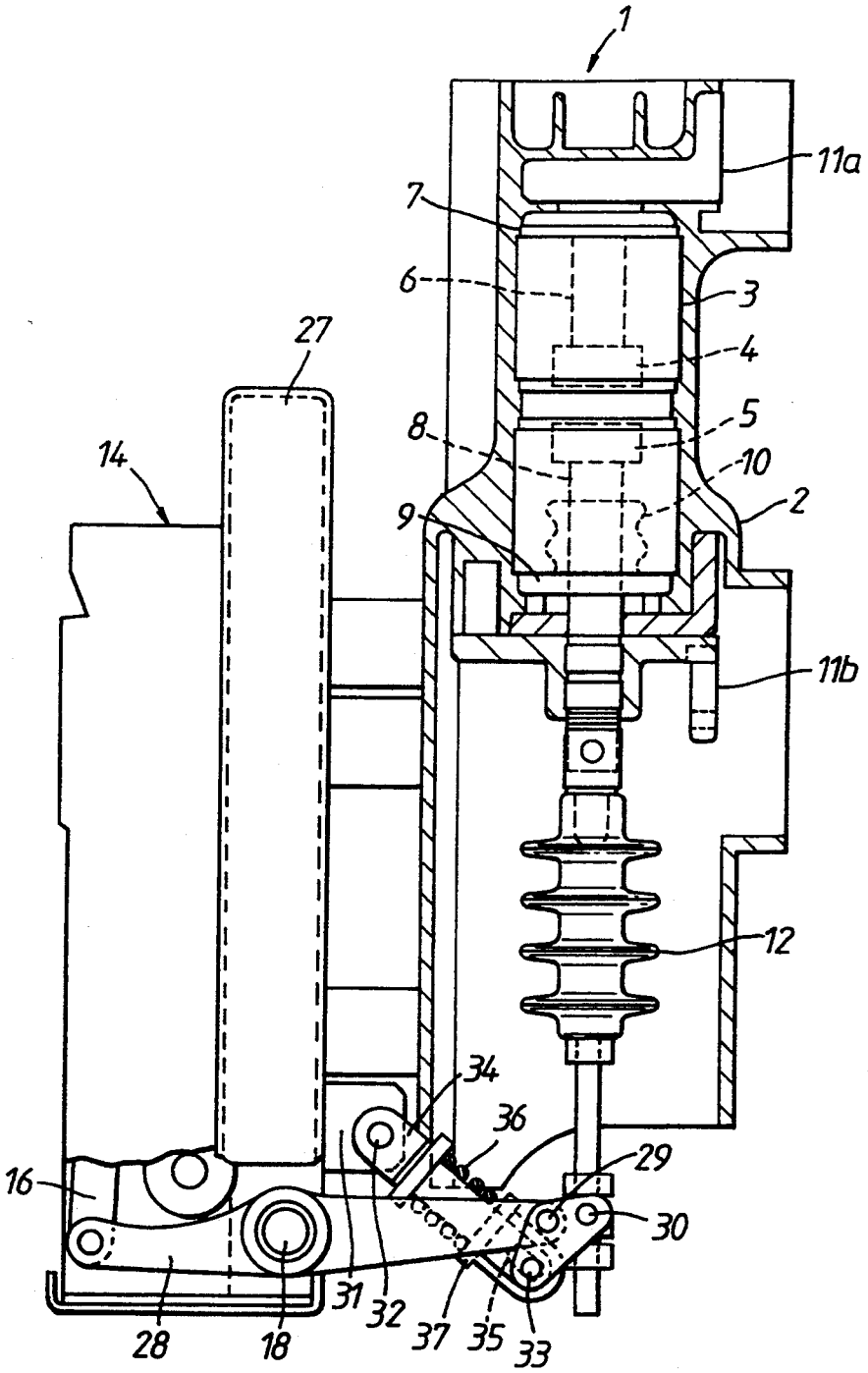
FIG. 2 is a constructional diagram showing a second embodiment of the invention.

In the embodiment shown in FIG. 2, support 31 is provided at a location in the vicinity above main shaft 18 on mounting frame 27. But this invention is not limited to this embodiment. Support 31 can be provided at a location in the vicinity below main shaft 18 on mounting frame 27 so long as the distance between support shaft 29 and the support shaft 32 is kept constant.

Since this invention is constructed as described above, mainly since contacts pressurizing spring is arranged in the dead space between two plates in drive lever, which is between main shaft and insulating rod, size reduction of the vacuum circuit breaker can be achieved.

The moment of inertia is also reduced since the pressurizing spring is arranged adjacent to the main shaft of the drive lever. This enables the speed of opening and closing of the vacuum interrupter to be raised.

Moreover, the amount of the contacts gap of the vacuum interrupter can be adjusted since it is possible to alter the angle of rotation of the crank lever with respect to the drive lever by altering the mounting position where the one end of the pressurizing spring is mounted on the frame. It is therefore not necessary to increase the length etc. of the drive lever in order to increase the contacts gap so as to raise the rated voltage. This makes it possible to reduce the size of the vacuum circuit breaker. Also, by increasing the angle of the pressurizing spring in the direction of the spring shaft with respect to the drive lever, the contacts pressurizing force is applied in the electrodes-opening direction, so the initial opening speed of the vacuum interrupter can be raised. This makes it possible to improve the breaking characteristics of the vacuum circuit breaker.

Obviously, numerous modifications and variations of the present invention are possible in light of the above teachings. It is therefore to be understood that within the scope of the appended claims, the invention may be practiced otherwise than as specifically described herein.

What is claimed is:

1. A vacuum circuit breaker, comprising:

a vacuum interrupter including a fixed electrode and a movable electrode arranged to be moved into contact with and separated from said fixed electrode;

a movable rod mounted on said movable electrode of said vacuum interrupter;

a main shaft;

drive lever means rotatably mounted on said main shaft for transmitting an operating force towards said vacuum interrupter;

crank lever means rotatably mounted at a working end of said drive lever means, the crank lever means including a first end linked to said movable rod for transmitting said operating force to said movable rod at said first end;

pressurizing means provided in said drive lever means and said crank lever means for generating a resilient force to resiliently maintain a closed condition of said vacuum interrupter; and said crank lever means including a second end linked to said pressurizing means for transmitting said resilient force to said movable rod.

2. The vacuum circuit breaker according to claim 1, wherein:

said pressurizing means includes a spring shaft and a contacts pressurizing spring fitted on said spring shaft for generating said resilient force.

3. The vacuum circuit breaker according to claim 2, wherein:

said drive lever means comprises two plates with a suitable spacing therebetween;

said crank lever means comprises two plates with said suitable spacing therebetween; and said pressurizing means is positioned in said spacing.

4. The vacuum circuit breaker according to claim 3, wherein:

a first end of said spring shaft is mounted on said drive lever means in the vicinity of said main shaft; and a second end of said spring shaft is linked to said second end of said crank lever means.

5. The vacuum circuit breaker according to claim 4, wherein:

said drive lever means includes a first support shaft in the vicinity of said main shaft;

said crank lever means includes a second support shaft at said second end of said crank lever means;

said first end of said spring shaft is mounted on said first support shaft; and said second end of said spring shaft is mounted on said second support shaft of said crank lever means.

6. The vacuum circuit breaker according to claim 3, wherein:

a first end of said spring shaft is mounted on a frame member in the vicinity of said main shaft; and a second end of said spring shaft is linked to said second end of said crank lever means.

7. The vacuum circuit breaker according to claim 6, further including a first support shaft mounted on said frame, wherein:

said crank lever means includes a second support shaft at said second end of said crank lever means;

said first end of said spring shaft is mounted on said first support shaft; and said second end of said spring shaft is mounted on said second support shaft of said crank lever means.

* * * * *